US005386679A

United States Patent [19]

Boriani et al.

[11] Patent Number: 5,386,679

[45] Date of Patent: Feb. 7, 1995

[54] METHOD AND DEVICE FOR FEEDING A WRAPPING MACHINE WITH PORTIONS OF WRAPPING MATERIAL

[75] Inventors: Silvano Boriani; Alessandro Minarelli, both of Bologna, Italy

[73] Assignee: G. D. Societa' Azioni, Bologna, Italy

[21] Appl. No.: 985,179

[22] Filed: Dec. 2, 1992

[30] Foreign Application Priority Data

Dec. 3, 1991 [IT] Italy ..... B091 A 000452

[51] Int. Cl.[6] ..... B65B 11/00; B65B 41/00

[52] U.S. Cl. ..... 53/461; 53/228; 53/389.3; 53/389.5

[58] Field of Search ..... 53/221, 225, 228, 389.3, 53/389.5, 461

[56] References Cited

U.S. PATENT DOCUMENTS

| | | | |
|---|---|---|---|
| 2,603,925 | 7/1952 | Moore | 53/389.3 |
| 3,150,475 | 9/1964 | Schooler | 53/228 |
| 3,177,746 | 4/1965 | Langer . | |
| 3,355,166 | 11/1967 | Plumb | 53/389.5 |
| 3,367,221 | 2/1968 | Schmermund | 53/389.3 |
| 3,385,026 | 5/1968 | Schmermund | 53/389.3 |
| 3,771,281 | 11/1973 | Witte | 53/389.3 |
| 3,841,057 | 10/1974 | Engeler | 53/389.3 |
| 4,385,479 | 5/1983 | Focke | 53/389.5 |
| 4,388,794 | 6/1983 | Focke et al. | 53/389.5 |
| 4,495,746 | 1/1985 | Focke et al. | 53/389.5 |
| 4,524,658 | 6/1985 | Focke et al. . | |

FOREIGN PATENT DOCUMENTS

| | | | |
|---|---|---|---|
| 0031515 | 7/1981 | European Pat. Off. . | |
| 0071736 | 2/1983 | European Pat. Off. . | |
| 1963956 | 8/1971 | Germany . | |
| 2410587 | 9/1975 | Germany | 53/228 |
| 1094351 | 12/1967 | United Kingdom . | |
| 2213456 | 8/1989 | United Kingdom . | |

*Primary Examiner*—W. Donald Bray
*Attorney, Agent, or Firm*—Klauber & Jackson

[57] ABSTRACT

A method and device for successively feeding portions of wrapping material to a wrapping machine, whereby the portions are drawn towards a transfer station by gripping devices on the forward branch of a conveyor having two belts and the return branch of which is located facing a folding seat on the wrapping machine; at the transfer station, each portion on the forward branch of the conveyor being moved through both belts and towards a respective folding seat by a respective product fed perpendicularly to the transportation surface of the conveyor.

24 Claims, 2 Drawing Sheets

FIG. 1A
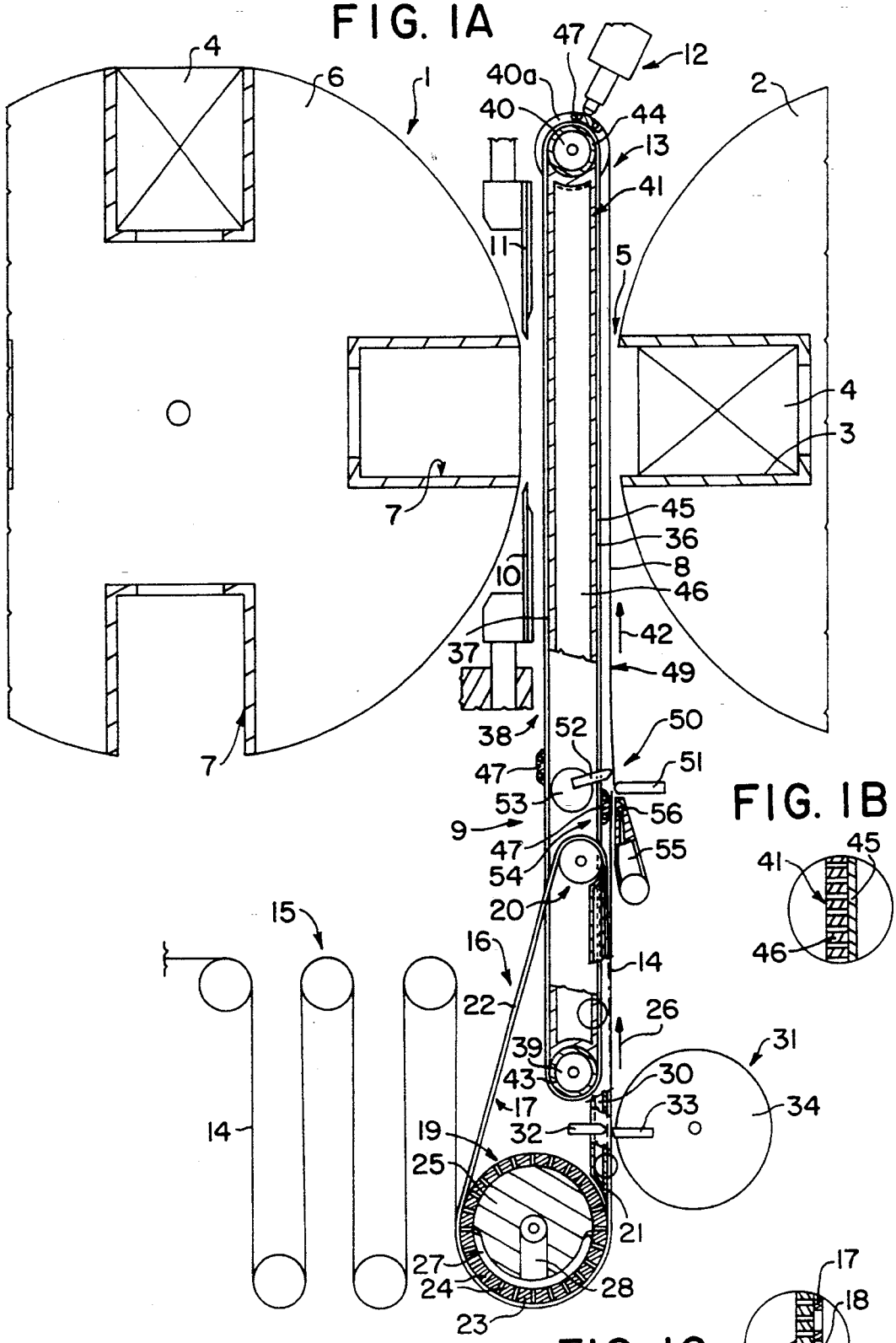
FIG. 1B
FIG. 1C
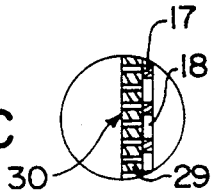

METHOD AND DEVICE FOR FEEDING A WRAPPING MACHINE WITH PORTIONS OF WRAPPING MATERIAL

BACKGROUND OF THE INVENTION

The present invention relates to a method of feeding a wrapping machine with portions of wrapping material.

On wrapping machines for forming overwrappings of paper or transparent material about a succession of products, the products are fed successively to a transfer station where each product is inserted inside a folding seat together with a portion of wrapping material, which, as the product is inserted inside the seat, is folded into a U about the product and subsequently closed by folding devices cooperating with the seat to form a tubular wrapping about the product.

On known wrapping machines of the aforementioned type, the portions of wrapping material are normally formed from a continuous strip fed towards the transfer station by two opposed push rollers downstream from which are provided, in succession: a gumming device, in the case of paper material, for gumming given points on the opposite surface of the strip to that facing the folding seat; a cutting unit comprising a fixed blade and a movable blade, for cutting the strip into portions; and a guide device extending through the transfer station and comprising guide strips positioned contacting the opposite surface of the portions to that facing the folding seat and defining a transportation surface perpendicular to the direction in which the products are fed towards the folding seat.

Consequently, the wrapping material is pushed towards the transfer station and, what is more, is gummed on the side facing the guide strips.

A first drawback of the above method is the possibility of the leading edge of the continuous strip remaining attached to the fixed blade on the cutting unit, thus resulting in curling of the strip when it is pushed forward by the push rollers. Moreover, withdrawal of the portions, for any reason, from the transfer station inevitably results in fouling of the guide strips by the gum with which the portions are coated.

SUMMARY OF THE INVENTION

It is an object of the present invention to provide a method of feeding portions of wrapping material to a wrapping machine, designed to overcome the aforementioned drawbacks.

According to the present invention, there is provided a method of feeding portions of wrapping material to a wrapping machine, whereby the portions having a first and second surfaces opposite to each other are fed successively, by feeding and guide means defining a transportation surface for said portions, to a transfer station wherein each portion is positioned facing a folding seat so as to interfere with a respective product movable through said feeding and guide means and towards said folding seat in a direction substantially perpendicular to said transportation surface; characterized by the fact that the portions are drawn by the feeding and guide means towards the transfer station; the feeding and guide means comprising means for gripping said portions, and transportation means which are activated for bringing said gripping means successively into engagement with said second surface of the portions, and so drawing the portions, via said gripping means, along the transportation surface and through the transfer station.

Each portion is preferably gummed on said first surface, which faces away from said seat and while on said transportation surface.

The portions are thus drawn, as opposed to pushed, towards the transfer station, thus eliminating any danger of the strip curling, and are gummed on the opposite surface to that contacting the transportation means, thus eliminating any possibility of the transportation means being fouled by the gum.

According to a preferred embodiment of the above method, said transportation means comprise two looped belts separated by a distance greater than the width of the portions, and comprising respective forward branches traveling towards the transfer station and facing said second surface of the portions, and respective return branches facing said seat; the gripping means located along said forward branches defining said transportation surface; and each portion being moved by the respective product through both the forward and return branches of said belts as it is inserted inside said seat.

Preferably, the leading end of each portion is engaged by said gripping means; and the portions are drawn upwards towards the transfer station by the feeding and guide means.

Preferably, the portions are formed from a continuous strip, the leading end of which is engaged by the feeding and guide means and drawn towards the transfer station; and each portion corresponds with a leading portion of the strip, which is cut off the strip when positioned astride the transfer station.

The present invention also relates to a device for feeding portions of wrapping material to a wrapping machine.

According to the present invention, there further provided a device for feeding portions of wrapping material to a wrapping machine, the portions having first and second surfaces opposite to each other, and the device comprising feeding and guide means defining a transportation surface for feeding the portions to a transfer station where each portion is positioned, in use, facing a folding seat so as to interfere with a respective product movable through said feeding and guide means and towards said folding seat in a direction substantially perpendicular to said transportation surface; characterized by the fact that the feeding and guide means comprise means for gripping said portions, and transportation means activated for bringing said gripping means successively into engagement with said second surface of the portions, and so drawing the portions, via said gripping means, along the transportation surface and through the transfer station.

BRIEF DESCRIPTION OF THE DRAWINGS

A non-limiting embodiment of the present invention will be described by way of example with reference to the accompanying drawings, in which:

FIG. 1 shows a partially sectioned, schematic side view, with parts removed for simplicity, of an overwrapping machine featuring a device for feeding portions of wrapping material in accordance with the teachings of the present invention;

DETAILED DESCRIPTION OF THE INVENTION

Figure 2:
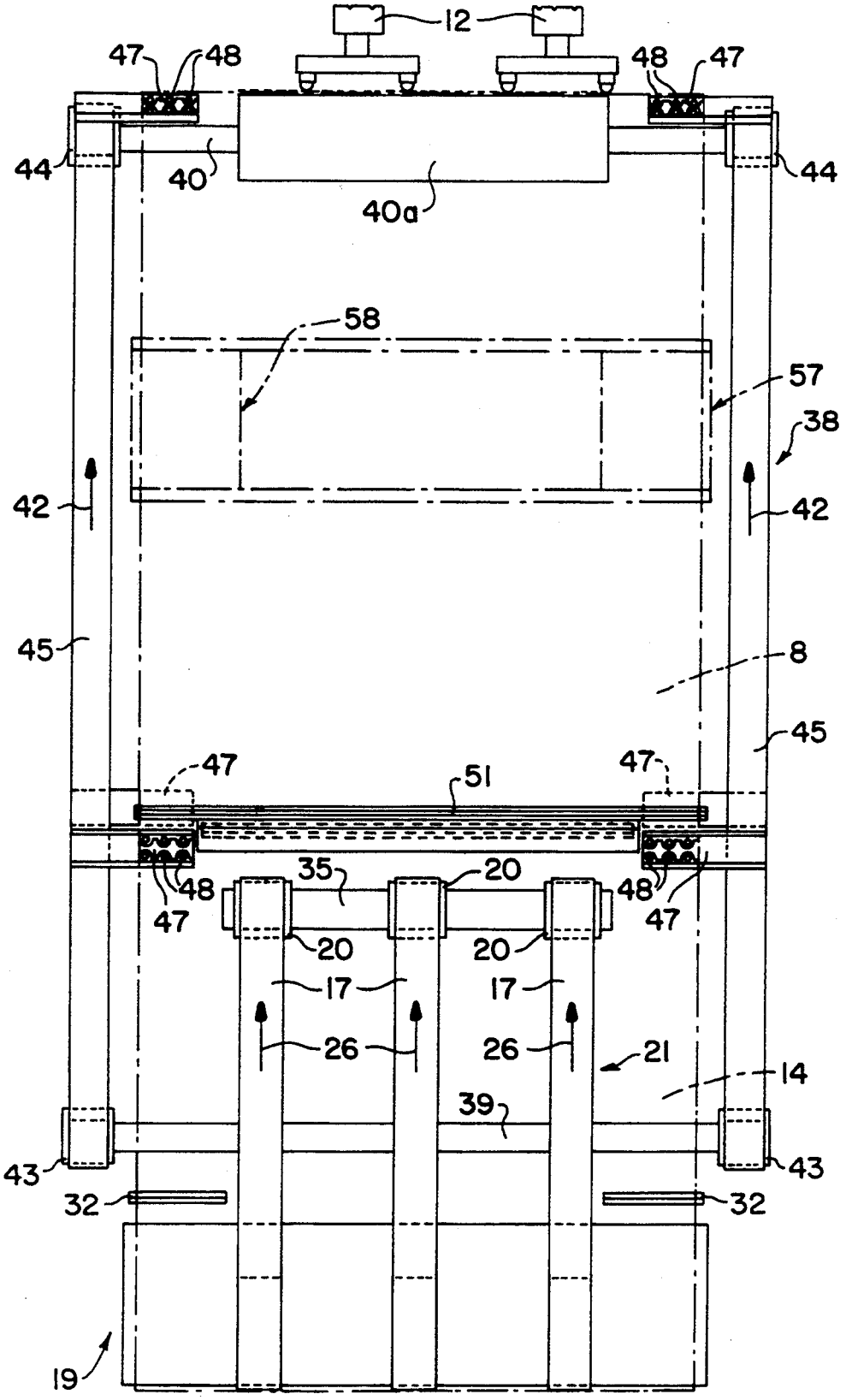
FIG. 2 shows a plan view of a detail in FIG.1.

Number 1 in FIG.1 indicates a known type of overwrapping machine comprising a supply wheel 2 having a number of peripheral transportation pockets 3 and rotating about is axis for successively feeding products 4 to a transfer station 5. Station 5 is located between wheel 2 and a wrapping wheel 6 having a number of peripheral seats 7 and rotating about its axis, parallel to the axis of wheel 2, in the opposite direction to and at the same surface speed as wheel 2.

At station 5, each seat 7 is designed to receive, in known manner, a respective product 4 and a portion 8 of wrapping material fed to station 5 by a feed device indicated as a whole by 9. Device 9 provides for successively arresting portions 8 between pocket 3 and respective seat 7 in station 5, so as to enable product 4, when pushed radially outwards of pocket 3 and towards wheel 6 by a known push device (not shown), to insert portion 8 inside seat 7 and fold it in a U about product 4. Portion 8 is subsequently folded fully about product 4 in known manner by activating two folding devices 10 and 11 located on either side of the mouth of seat 7 in station 5, and which provide in known manner for forming a tubular wrapping (not shown), one side of which consists of two opposite portions (not shown) of portion 8 folded integrally one on top of the other.

Should portion 8 consist of paper material, said two portions (not shown) are connected by means of gum deposited by gumming devices 12 on surface 13 of portion 8 facing wheel 2 when portion 8 reaches station 5.

Feed device 9 comprises a reel (not shown) for a continuous strip 14 of wrapping material, which is run off through a known type of compensating store 15 to a first conveyor 16 of device 9.

Conveyor 16 comprises three permeable belts 17 (FIG.2), each having a number of through holes 18, and each looped about two pulleys 19 and 20 defining, on conveyor 16, a forward branch 21 and a return branch 22, each narrower than strip 14. Pulley 19 is a known type of suction pulley comprising a powered outer rim 23 having a number of radial through holes 24 at and/or between belts 17, and mounted on a fixed inner drum 25 so as to rotate anticlockwise (in FIG. 1) about drum 25 and move forward branch 21 of conveyor 16 in direction 26 extending parallel to the FIG. 2 plane, perpendicular to the respective axes of wheels 2 and 6, and vertically upwards towards station 5. Drum 25 presents an outer chamber 27 extending over the arc of contact between rim 23 and belts 17 and communicating with a suction conduit 28 formed centrally through drum 25.

Between pulleys 19 and 20, the inner surface of forward branch 21 travels contacting a perforated wall 29 of a suction box 30 extending through a first cutting unit indicated as a whole by 31 and which, in certain cases, may be eliminated as explained in more detail later on.

Cutting device 31 comprises two fixed blades 32 aligned on either side of box 30 between branches 21 and 22; and two movable blades 33 projecting radially outwards from the periphery of a powered roller 34 rotating clockwise (in FIG. 1) about an axis perpendicular to the FIG. 1 plane and parallel to the respective axes of wheels 2 and 6.

Pulleys 20 are fitted on to the same shaft 35 located between the forward branch 36, facing wheel 2, and the return branch 37, facing wheel 6, of a second conveyor 38 extending vertically through station 5 and between wheels 2 and 6.

Conveyor 38 comprises two shafts 39 and 40 parallel to each other and to shaft 35, and located at the opposite ends of a supporting frame 41 extending through station 5. More specifically, shaft 39 extends in the gap between branches 21 and 22 of conveyor 16; and one of shafts 39, 40 is powered for moving forward branch 36 of conveyor 38 in vertical direction 42 parallel to direction 26. The opposite ends of shafts 39 and 40 are fitted with respective pairs of pulleys 43 and 44 supporting two looped belts 45 parallel to each other and to belts 17 and separated by a distance greater than the width of strip 14.

Frame 41 comprises two suction boxes 46 located inside the forward and return branches of each belt 45 and communicating with suction conduits (not shown) formed through appendixes 47 integral with and extending from each belt 45 towards the other belt 45. Each appendix 47 corresponds with an appendix 47 on the other belt 45, so that the distance between each pair of corresponding appendixes 47 is less than the width of strip 14. Moreover, each appendix 47 presents, on the outward-facing surface, a number of suction holes 48 communicating with said conduits (not shown).

Said outer surfaces of appendixes 47 define, along forward branch 36 of conveyor 38, a transportation surface 49 of conveyor 38.

The central portion of shaft 40 is fitted with a roller **40*a* positioned facing a pair of gumming devices 12**.

Forward branch 36 of conveyor 38 extends through a further cutting device 50 located upstream from station 5 and at a distance from gumming devices 12 substantially equal to the length of portion 8. Cutting device 50 comprises a fixed blade 51 mounted outwards of conveyor 38, facing branch 36, and parallel to shafts 39 and 40, and which presents a cutting edge facing and slightly outwards of transportation surface 49. In addition to fixed blade 51, which is longer than the width of strip 14, device 51 comprises a corresponding movable blade 52 projecting radially outwards from the periphery of a powered roller 53 supported on boxes 46 between branches 36 and 37 and rotating anticlockwise in FIG.1 about an axis perpendicular to the FIG.1 plane and parallel to the respective axes of wheels 2 and 6.

As shown in FIG. 1, fixed blade 51 is located immediately downstream, in direction 42, from a cutting station 54 extending between shaft 35 and fixed blade 51 along forward branch 36 of conveyor 38. At cutting station 54, cutting device 50 comprises a detaching member 55 having a suction device 56 and located outwards of conveyor 38, on the same side as fixed blade 51, so as to oscillate between a gripping position, wherein member 55 is substantially coplanar with the cutting edge of fixed blade 51, and an operating position wherein member 55 is substantially coplanar with transportation surface 49.

Finally, at station 5, feed device 9 comprises a known type of folding spindle 57 defining a passage 58 of the same section as pockets 3 and seats 7.

In actual use, after running through store 15, strip 14 contacts conveyor 16 on the outer surface of pulley 19, which, by virtue of the suction through holes 24 in rim 23, feeds the leading end of strip 14 to forward branch 21 of conveyor 16. Along forward branch 21, strip 14 is held contacting belts 17 by the suction through wall 29 of box 30, and, if necessary, is engaged by cutting device 31, which makes two partial lateral cuts (not shown) in strip 14 for defining, on strip 14, the end folds (not shown) of portions 8 to be cut off strip 14. Obviously, cutting device 31 is deactivated or eliminated when, as is often the case with transparent wrapping material, no end folds are required on portions 8.

The leading end of strip 14 travels along the whole of forward branch 21 to transportation surface 49, which is coplanar with the outer surface of the portion of belts 17 extending along forward branch 21. The leading end of strip 14 reaches transportation surface 49 simultaneously with a pair of appendixes 47 which are engaged by a leading portion of strip 14 by virtue of the suction through holes 48. Conveyors 16 and 38, which are operated in steps and at the same speed, are stopped upon said pair of appendixes 47 reaching cutting station 54, and for as long as required for enabling cutting device 50 (as explained later) to perform a cutting operation, which, at least in this first case, is superfluous by virtue of the leading end of strip 14 being arrested facing the cutting edge of fixed blade 51.

A further operating step of conveyor 38 feeds said pair of appendixes 47 up to the periphery of roller 40*a*, so that the leading end of strip 14 is drawn through transfer station 5 and into engagement with gumming devices 12, which provide for gumming given portions of surface 13 on the end portion of strip 14.

When conveyor 38 stops, a further pair of appendixes 47, engaged by strip 14, is arrested in cutting station 54, at which point, strip 14 is cut between movable blade 52 and fixed blade 51. When cut, the end of strip 14 may become detached from appendixes 47 and adhere to the edge of fixed blade 51. Detaching member 55, in the gripping position, therefore retains strip 14 by suction and, by rotating anticlockwise into the operating position, detaches strip 14 from the edge of blade 51 so that it again adheres to respective pair of appendixes 47.

At this point, a product 4, housed inside pocket 3 in station 5, is extracted from pocket 3 in a direction perpendicular to transportation surface 49, and fed between belts 45 and through spindle 57 into a corresponding seat 7 also located in station 5 and facing respective pocket 3. In the course of the above operation, product 4 engages and detaches portion 8 from respective appendixes 47, folds it in a U as it moves through spindle 57, and feeds it, so folded, into seat 7 so that two end portions (not shown) of portion 8 project from seat 7, and one of which is gummed on the side facing the other end portion. Folding devices 10 and 11 then fold the two end portions (not shown) one on top of the other, with the gummed end portion (not shown) on the outside, to produce a tubular wrapping (not shown) about product 4.

Clearly, therefore, by virtue of the leading edge of strip 14 being drawn, as opposed to pushed, along transportation surface 49 and through station 5, no possibility exists of strip 14 curling as it travels through station 5 or, more especially, as it is detached from fixed blade 51. Moreover, the fact that each portion 8 is pushed through both the forward and return branches 36 and 37 of conveyor 38, and is gummed while on transportation surface 49 and on the side facing wheel 2, prevents any possibility of the gum on portion 8 fouling belts 45.

We claim:

1. A method for feeding portions (8) of wrapping material to a transfer station (5), wherein said transfer station (5) defines a position between a supply pocket (3) and a wrapping seat (7) in a wrapping machine (1), said method comprising the steps of:

bringing said portions (8) of wrapping material into engagement with a gripping means (47) integral with and extending from a looped conveying means (38);

gripping said portions (8) of wrapping material with said gripping means (47); and transporting said portions (8) of wrapping material, via said looped conveying means (38), along a transportation surface (49) and through said transfer station (5), such that, in use, each said portion (8) of wrapping material will interfere with a product (4) that is movable from said supply pocket (3) to said wrapping seat (7) through said transfer station (5) in a direction substantially perpendicular to said transportation surface (49).

2. The method as claimed in claim 1, wherein said step of transporting comprises the step of conveying said gripping means (47), and hence said portions (8) of wrapping material, along said transportation surface (49).

3. The method as claimed in claim 1, further comprising the step of gumming a surface (13) of each said portion (8) of wrapping material with a gumming means (12), said gumming means (12) being positioned, in use, facing said surface (13) of each said portion (8) of wrapping material for gumming said surface (13) of each said portion (8) of wrapping material while on said transportation surface (49).

4. The method as claimed in claim 3, further comprising the step of locating said gumming means (12) along said transportation surface (49) downstream from said transfer station (5).

5. The method as claimed in claim 4, further comprising the step of cutting a leading portion off a continuous strip (14) of wrapping material with a cutting means (50) so as to form each said portion (8) of wrapping material.

6. The method as claimed in claim 5, further comprising the step of locating said cutting means (50) along said transportation surface (49), upstream from said transfer station (5), and on the opposite side of said transfer station (5) to said gumming means (12), the distance between said cutting means (50) and said gumming means (12) being substantially equal to the length of each said portion (8) of wrapping material.

7. The method as claimed in claim 1, further comprising the steps of:

arranging a first conveyor (16) and said looped conveying means (38) in series for feeding a leading portion of a continuous strip (14) of wrapping material along said transportation surface (49) and through said transfer station (5), said first conveyor (16) being a suction conveyor and being located upstream from said second conveyor (38), said looped conveying means (38) comprising a second conveyor (38) defining said transportation surface (49) and extending through said transfer station (5); and cutting said leading portion off said continuous strip (14) of wrapping material with a cutting means (50) so as to form each said portion (8) of wrapping material.

8. The method as claimed in claim 1, further comprising the steps of:

locating said gripping means (47) along said transportation surface (49); and separating a corresponding pair of elements (36,37) of said gripping means (47) by a distance smaller than the width of said portions (8) of wrapping material.

9. A method for feeding portions (8) of wrapping material to a transfer station (5), wherein said transfer station (5) defines a position between a supply pocket (3) and a wrapping seat (7) in a wrapping machine (1), said method comprising the steps of:

feeding and guiding said portions (8) of wrapping material via a looped conveying means (38) along a transportation surface (49) through said transfer station (5), such that, in use, each said portion (8) of wrapping material will interfere with a product (4) that is movable from said supply pocket (3) to said wrapping seat (7) through said transfer station (5) in a direction substantially perpendicular to said transportation surface (49).

10. The method as claimed in claim 9, wherein said steps of feeding and guiding comprise the steps of:

bringing said portions (8) of wrapping material into engagement with gripping means (47) integral with and extending from said looped conveying means (38);

gripping said portions (8) of wrapping material with said gripping means (47); and transporting said portions (8) of wrapping material, via said looped conveying means (38), along said transportation surface (49) and through said transfer station (5).

11. The method as claimed in claim 10, wherein said step of transporting comprises the step of conveying said gripping means (47), and hence said portions (8) of wrapping material, along said transportation surface (49).

12. The method as claimed in claim 10, further comprising the step of gumming a surface (13) of each said portion (8) of wrapping material with a gumming means (12), said gumming means (12) being positioned, in use, facing said surface (13) of each said portion (8) of wrapping material for gumming said surface (13) of each said portion (8) of wrapping material while on said transportation surface (49).

13. The method as claimed in claim 12, further comprising the step of locating said gumming means (12) along said transportation surface (49) downstream from said transfer station (5).

14. The method as claimed in claim 13, further comprising the step of cutting a leading portion off a continuous strip (14) of wrapping material with a cutting means (50) so as to form each said portion (8) of wrapping material.

15. The method as claimed in claim 14, further comprising the step of locating said cutting means (50) along said transportation surface (49), upstream from said transfer station (5), and on the opposite side of said transfer station (5) to said gumming means (12), the distance between said cutting means (50) and said gumming means (12) being substantially equal to the length of each said portion (8) of wrapping material.

16. The method as claimed in claim 10, further comprising the steps of:

arranging a first conveyer (16) and said looped conveying means (38) in series for feeding a leading portion of a continuous strip (14) of wrapping material along said transportation surface (49) and through said transfer station (5), said first conveyor (16) being a suction conveyor and being located upstream from said looped conveying means (38), said looped conveying means (38) comprising a second conveyor (38) defining said transportation surface (49) and extending through said transfer station (5); and cutting said leading portion off said continuous strip (14) of wrapping material with a cutting means (50) so as to form each said portion (8) of wrapping material.

17. The method as claimed in claim 10, further comprising the steps of:

locating said gripping means (47) along said transportation surface (49); and separating a corresponding pair of elements (36,37) of said gripping means (47) by a distance smaller than the width of said portions (8) of wrapping material.

18. A device (9) for feeding portions (8) of wrapping material to a wrapping machine (1), said device (9) comprising:

means (38) for feeding and guiding said portions (8) of wrapping material along a transportation surface (49) and through a transfer station (5), said feeding and guiding means (38) defining said transportation surface (49), said transfer station (5) defining a position between a supply pocket (3) and a wrapping seat (7) in said wrapping machine (1), said feeding and guiding means (38) comprising means (47) for gripping said portions (8) of wrapping material and looped conveying means (38) for bringing said gripping means (47) into engagement with said portions (8) of wrapping material and for transporting said portions (8) of wrapping material along said transportation surface (49) and through said transfer station (5), such that, in use, each said portion (8) of wrapping material will interfere with a product (4) that is movable from said supply pocket (3) to said wrapping seat (7) through said feeding and guide means (38), and hence through said transfer station (5), in a direction substantially perpendicular to said transportation surface (49).

19. The device as claimed in claim 18, wherein said looped conveying means (38) comprises two parallel-looped belts (45) separated by a distance greater than the width of said portions (8) of wrapping material, and wherein said gripping means (47) is integral with and conveyed on said belts (45) and extended from each belt towards the other belt, said belts (45) comprising respective forward branches (36) being positioned, in use, facing said supply pocket (3), and respective return branches (37) being positioned, in use, facing said wrapping seat (7), said gripping means (47) defining, along said forward branches (36), said transportation surface (49).

20. The device as claimed in claim 18, wherein said transportation surface (49) is vertical, and wherein said gripping means (47) is conveyed upwards along said transportation surface (49).

21. The device as claimed in claim 11, further comprising means (12) for gumming a surface (13) of each said portion (8) of wrapping material, said gumming means (12) being positioned, in use, along said transportation surface (49), downstream from said transfer station (5), facing said surface (13) of each said portion (8) of wrapping material for gumming said surface (13) of each said portion (8) of wrapping material while on said transportation surface (49).

22. The device as claimed in claim 21, further comprising means (50) for cutting a leading portion off a continuous strip (14) of wrapping material so as to form each said portion (8) of wrapping material, said cutting means (50) being positioned, in use, along said transportation surface (49), upstream from said transfer station (5), and on the opposite side of said transfer station (5) to said gumming means (12), the distance between said cutting means (50) and said gumming means (12) being substantially equal to the length of each said portion (8) of wrapping material.

23. The device as claimed in claim 18, further comprising:

a first conveyer (16) and said looped conveying means (38) arranged in series for feeding a leading portion of a continuous strip (14) of wrapping material and along said transportation surface (49) and through said transfer station (5), said first conveyor (16) being a suction conveyor and being located upstream from said looped conveying means (38), said looped conveying means (38) comprising a second conveyor (38) defining said transportation surface (49) and extending through said transfer station (5); and means (50) for cutting said leading portion off said continuous strip (14) of wrapping material so as to form each said portion (8) of wrapping material.

24. The device as claimed in claim 18, wherein said gripping means (47) comprises pairs of suction appendixes (47) located along said transportation surface (49), said pairs of suction appendixes (47) being separated by a distance smaller than the width of said portions (8) of wrapping material.

* * * * *

UNITED STATES PATENT AND TRADEMARK OFFICE

CERTIFICATE OF CORRECTION

PATENT NO. : 5,386,679

DATED : FEBRUARY 7, 1995

INVENTOR(S) : SILVANO BORIANI & ALESSANDRO MINARELLI

It is certified that error appears in the above-indentified patent and that said Letters Patent is hereby corrected as shown below:

On the Title page, item [73], please change Assignee to read

-- G. D SOCIETA' PER AZIONI --.

Signed and Sealed this

Tenth Day of October, 1995

*Attest:*

Bruce Lehman

BRUCE LEHMAN

*Attesting Officer*

*Commissioner of Patents and Trademarks*